United States Patent [19]

Messerschmidt

[11] 4,023,393

[45] May 17, 1977

[54] ECCENTRIC PRESS

[75] Inventor: Klaus Messerschmidt, Schonungen, Germany

[73] Assignee: Sebastian Messerschmidt Spezial-maschinenfabrik, Schonungen, Germany

[22] Filed: July 15, 1976

[21] Appl. No.: 705,726

[30] Foreign Application Priority Data

July 16, 1975 Germany ..... 2531760

[52] U.S. Cl. ..... 72/337; 10/11 T; 10/12 T; 10/25; 10/72 T; 10/166; 72/331; 72/338

[51] Int. Cl.[2] ..... B21D 28/00

[58] Field of Search ..... 72/337, 338, 332, 326, 72/324, 361, 360, 404, 416, 331; 29/148.4 B, 148.4 R; 10/11 R, 11 T, 12 R, 12 T, 25, 72 R, 72 T, 166

[56] References Cited

UNITED STATES PATENTS

| | | | |
|---|---|---|---|
| 2,936 | 11/1863 | Watkins | 10/12 R |
| 46,434 | 2/1865 | Watkins | 10/12 R |
| 756,212 | 4/1904 | Campbell | 72/337 |
| 1,857,997 | 5/1932 | Brennan | 72/416 X |
| 1,897,359 | 2/1933 | Brennan | 72/337 |
| 2,315,769 | 4/1943 | Carney | 10/12 R |
| 2,800,814 | 7/1957 | Lewis | 72/361 X |
| 2,966,087 | 12/1960 | Gray | 29/148.4 B X |
| 3,919,874 | 11/1975 | Harris | 72/337 |

*Primary Examiner*—James R. Duzan
*Attorney, Agent, or Firm*—Frank J. Jordan

[57] ABSTRACT

A press for forming articles such as sphere-like objects and the like from workpieces includes a frame having two fixed mating dies mounted thereon and a crankshaft rotatably mounted on said frame, the crankshaft having crank arms actuating movable dies. A stationary shearing bushing means is disposed between the two fixed dies, and means are provided for feeding an elongated rod to the shearing bushing means. The shearing bushing means has an entry side and an exit side, and a movably mounted shearing knife means mounted on the entry side of the shearing bushing means is operable to cut blanks from the elongated rod. A feeding means is movably mounted on the exit side of the shearing bushing means and is operable to simultaneously receive a cut blank at the exit side of the shearing bushing means while delivering another cut blank to one of the fixed dies.

14 Claims, 12 Drawing Figures

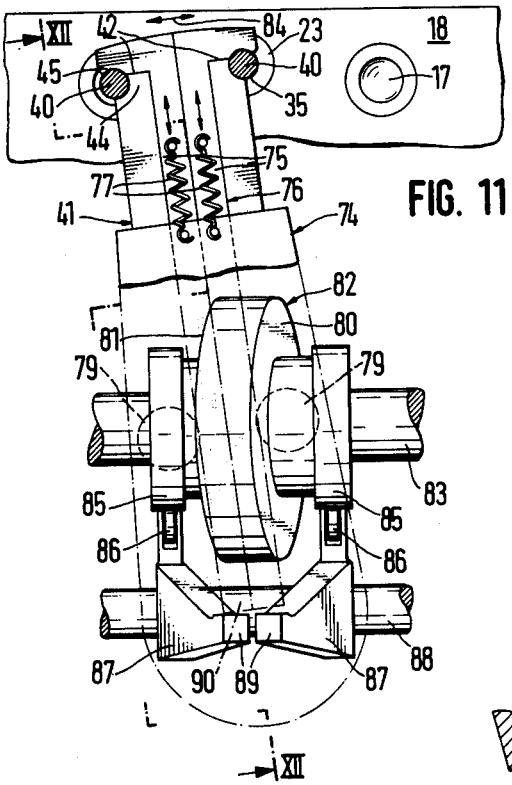
FIG. 11
FIG. 12
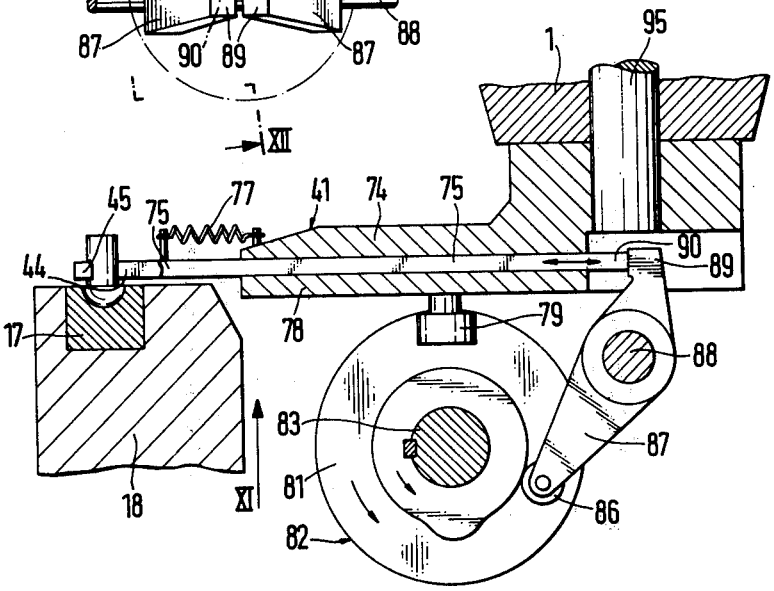

ECCENTRIC PRESS

BACKGROUND OF THE INVENTION

The invention relates to an eccentric press for molding simple workpieces, for example, balls or the like objects, from rod or strip offcuts or the like, in each of two press molds arranged one on either side of a feed device and having a reciprocating die and a stationary die fixed in the press frame, wherein the workpieces to be molded are cut off by a shearing knife reciprocatable transversely to the direction of advancement of the workpiece stock and are delivered alternately to one of the two press mods by a feed device driven in synchronism with the shearing knife.

In heretofore known conventional eccentric presses of this type a pressing operation would take place at each full revolution of the eccentric shaft, and this generally takes place in the forward movement of the slide carrying the movable die. The exceptionally high forces which come into action in this operation demand a correspondingly great degree of stability of the bed of the press supporting the stationary die. The output of such a press depends solely upon the speed with which one working cycle is completed, that is to say one opening and closing operation of the two dies as well as the feeding of the working material. However, an increase in the working speed is in practice only achievable at the expense of the masses being moved to the reduction of which narrow limits are set. For the purpose of increasing the output of such eccentric presses while at the same time achieving an economic utilization of the structural possibilities of a simple press it has already been proposed to arrange at each side of a feed device a respective press mold whose movable dies are driven by the eccentric shaft having crank portions staggered through 180°. Between the two stationary dies there is mounted a reciprocatable shearing knife, which is provided at both of its end faces with a cutter and a workpiece recetacle for alternate feeding to a respective one of the two dies, such as disclosed in U.S. Patent applicaton Ser. No. 545,062 filed Jan. 29, 1975, now U.S. Pat. No. 3,972,216.

The present invention is based upon such an improved eccentic press and takes as its purpose the improvement and simplification of the functional cycle of such apparatus, particularly for the purpose of achieving a higher output.

For this purpose according to the present invention the shearing knife is arranged at the workpiece entry side, and the feed device is arranged at the ejection side of a stationary shearing bushing guiding the rod stock forming the workpiece, while the feed device is mounted for movement in synchronism with the press working cycle between the ejection side of the shearing bushing and alternate ones of the two press molds in such a manner that the feed device simultaneously receives a workpiece at the ejection side of the shearing bushing while it is delivering another workpiece at one of the press molds.

The separation of the shearing function from the feeding function is the condition for the employment of a shearing knife which performs only a small reciprocating movement with respect to a fixed shearing anvil acting as an opposing cutting edge behind the shearing knife in the direction of motion. After the ejection from the shearing anvil of the previously cut off workpiece, the latter is gripped by the feed device which assumes a purely transporting function to deliver the workpiece alternately to one of the two press molds. The fact that each function of the apparatus is allocated to an individual member makes it possible to simplify the structure of the press and to increase its efficiency.

According to a further feature of the invention the shearing knife is in the form of an annular knife guiding the rod of working material, the stroke of this knife being smaller than the diameter of the rod. Experience has shown that the stroke needs only be one-third of the thickness of the workpiece which is to be separated, that is to say one-third of the diameter of the width of the workpiece rod. This depth of cut is completely adequate for the parting operation because the remainder of the cross section of the workpiece breaks away. The separated workpiece is first of all fed into the shearing anvil and is only ejected upon displacement of the supply of material.

It falls within the scope of the invention to arrange at a suitable distance from the ejection aperture of the shearing anvil a stop, preferably an adjustable stop, for limiting the feed of the workpiece material.

By the adoption of this simple procedure in combination with a selection of the profiles of working material which are available it is possible to design the dimensions of the blanks of raw material necessary for producing various balls.

More particularly in a further embodiment of the invention taking a particularly advantageous practical form, the feed device includes at least two sets of gripper jaws which are arranged to be movable between the ejection side of the shearing bushing and a respective one of the press molds, such movement taking place in at least an arcuate path about an axis directed substantially parallel to the axis of the shearing bushing. In any case preferably the drive for the feed device is derived from the press drive itself in order to maintain the necessary synchronisation of the various movements. While one set of grippers is situated before the ejection opening of the shearing bushing for the purpose of accepting at that position a workpiece blank cut off in a previous working cycle, another set of grippers is feeding a similar workpiece blank between the two dies of the press mold. The condition of the feed device is therefore that it is either in the course of making its reciprocating movement or else is in a temporary state of rest prior to making such movement. With each new movement of the feed device, the one set of grippers travels from the shearing bushing to the other press mold while the other set of grippers arrives in front of the ejection opening of the shearing bushing. This working cycle is continuously repeated.

In a particular practical form of the invention the feed device includes a double armed pivoted lever carrying upon each arm a set of grippers, whereby each arm reciprocates between the ejection side of the shearing bushing and a respective press mold. This motion can be derived, for example, from a crank drive. In this practictical example the press molds and the shearing bushing are situated upon a common arc whose radius corresponds to that form the opening in the grippers to the pivot axis of the feed device.

A further practical form of the invention makes use of a feed device having two synchronously driven pivoting arms each of which has a set of grippers at each end thereof, these pivoting arms rotating about parallel pivoting axes and being angularly staggered with respect to each other, and the arcuate paths of the pivoting arms touching each other at a contact point at which is situated the ejection opening of the shearing bushing, while a press mold is arranged upon each individual arcuate path. Advantageously the two pivoting arms have a Maltese cross drive. This operates directly upon the one pivoting arm, which in turn is in driving connection with the other pivoting arm through a chain drive or the like.

The invention provides a further alternative arrangement, wherein the feed device has two sets of grippers and is mounted for reciprocating movement along a linear path between the two press molds and the intervening shearing bushing in which case the spacing distance of a respective press mold from the shearing bushing, corresponds to that between the two sets of grippers. Each of the various design possibilities for the feed device contributes, together with the provision of the shearing knife in accordance with the invention, to the result that the function of cutting the workpiece blank is separated from the function of conveying the cut workpiece to the respective press mold which fact alone achieves an increase in output representing a multiple of that produced by conventional ball presses.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

SUMMARY OF THE INVENTION

A press for forming articles such as sphere-like objects and the like from workpieces comprises a frame having two fixed mating dies mounted thereon and a crankshaft rotatably mounted on the frame, the crankshaft having crank arms actuating movable dies. A stationary shearing bushing means is disposed between the two fixed dies, and means are provided for feeding an elongated rod to the shearing bushing means. The shearing bushing means has an entry side and an exit side, and a movably mounted shearing knife means mounted on the entry side of the shearing bushing means is operable to cut blanks from the elongated rod. A feeding means is movably mounted on the exit side of the shearing bushing means and is operable to simultaneously receive a cut blank at the exit side of the shearing bushing means while delivering another cut blank to one of the fixed dies.

BRIEF DESCRIPTION OF THE DRAWINGS

FIG. 11 is a further practical form of the feed device when viewed in the direction of the arrow XI in FIG. 12.

FIG. 12 is a sectional view taken along the line XII—XII in FIG. 11.

DESCRIPTION OF THE PREFERRED EMBODIMENTS

Figure 1:
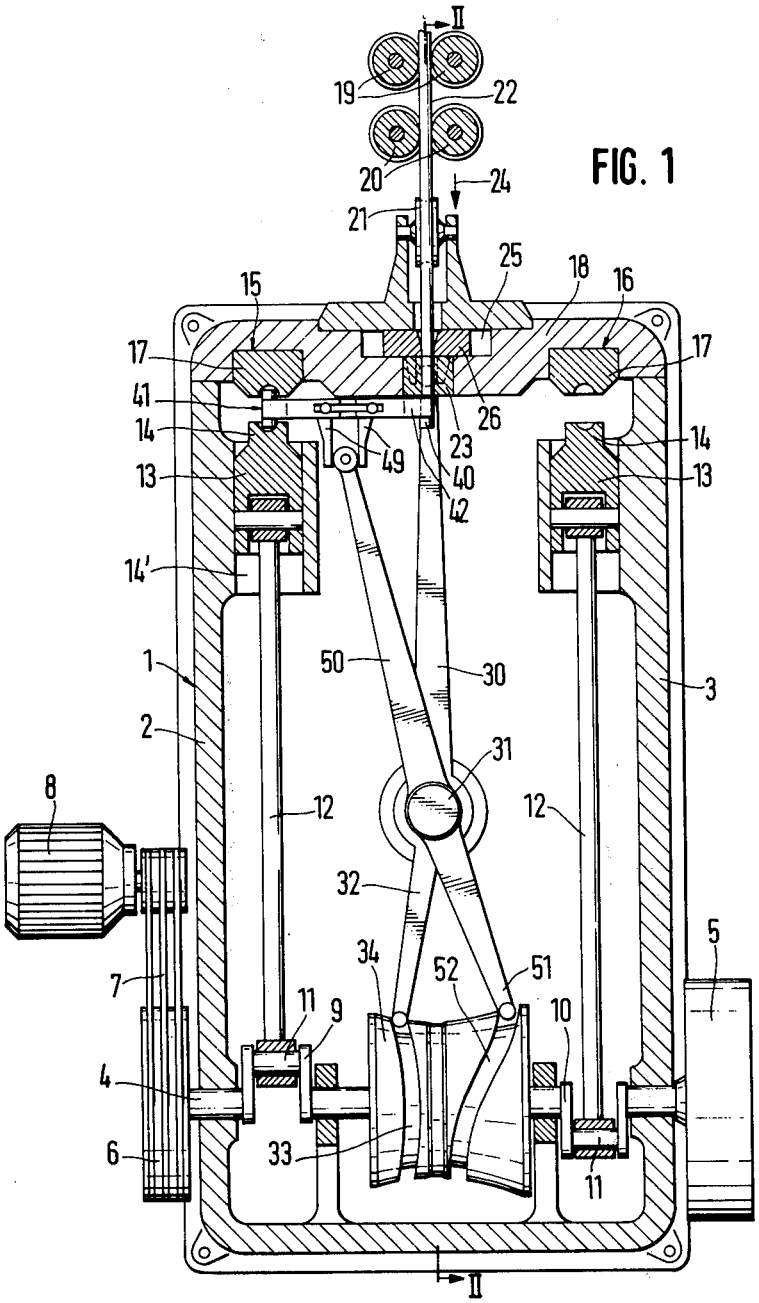
FIG. 1 is a horizontal section view through one embodiment of an apparatus according to the present invention.
Figure 2:
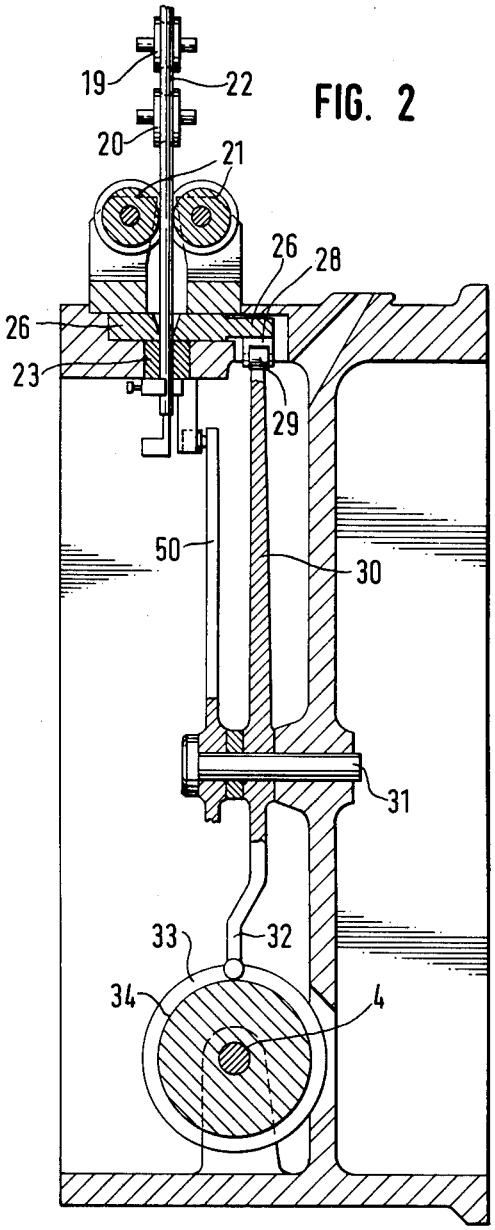
FIG. 2 is a longitudinal section taken on the line II—II in FIG. 1.

Referring to the drawings a frame 1 of an eccentric press forms a closed rectangle having longitudinal portions 2, 3 on which an eccentic shaft 4 is mounted in bearings. The eccentric shaft 4 carries a flywheel 5 on one longitudinal end and at its other longitudinal end a belt pulley 6 driven by an electric motor 8 through a belt transmission 7. The eccentric shaft 4 is provided with crank arms 9 and 10 mutually staggered 180° apart and carrying crank pins 11 to which are coupled crank rods 12 each connected at their other end to a slide 13 arranged for longitudinal movement in a guide track 14' of the frame 1. Upon each of these slides 12 there is arranged a movable die 14 of a press mold indicated generally at 15 and 16 respectively, the latter each having a fixed die 17 supported in a yoke portion 18 of the frame 1.

At the end of the frame 1 of the eccentic press is an arrangement for advancing a workpiece comprising two pairs of rollers 19 and 20 and a pair of rollers 21 disposed in a vertical plane. These rollers serve to advance a blank stock consisting of a profiled rod or wire or the like 22, which is drawn off, for example, from a roll 23'. The rod or wire 22 is advanced into a shearing bushing 23 securely anchored to the frame yoke 18 and having a free aperture dimension which conform generally to the profile of the rod or wire material 22.

In a cavity 25 of the frame yoke 18 situated in front of the shearing bushing 23 as seen in th direction 24 of stock feed, there is mounted an annular cutter 26 through a central aperture 27 of which the rod material is guided. The head 29 of a double armed lever 30 engages between two extensions 28 of the annular cutter 26 directed towards the interior space of the frame 1, such double arm lever 30 being pivotally mounted in a horizontal plane about a pivot shaft 31 mounted in the frame 1, the other end 32 of the lever 30 engaging in the track of a cam disc mounted upon the crank shaft 4 of the press.

Figure 3:
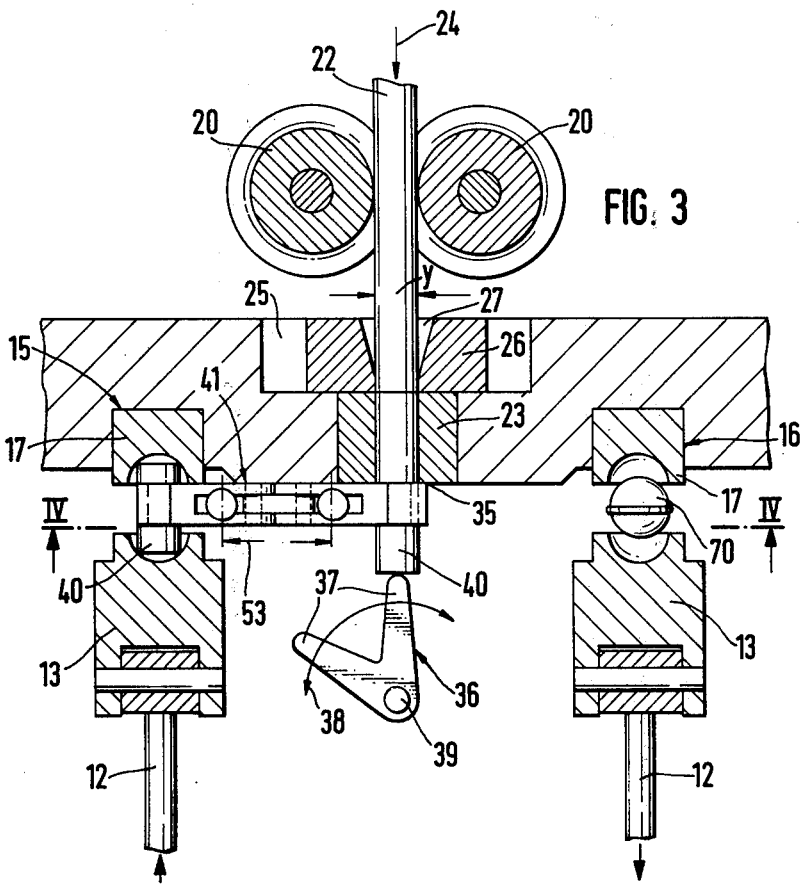
FIG. 3 is an enlarged detail of FIG. 1.

At a suitable distance from an ejection aperture 35 of the shearing bushing 23 there is arranged a pivoted stop 36, FIG. 3, the two arms 37 of which alternately come into alignment with the ejection aperture 35 of the shearing bushing 23 as indicated by the double arrow 38 in FIG. 3. Alternatively, a stationary stop could be used in place of this pivoted stop 36. The clearance of the pivoted stop 36 from the ejection aperture 35 of the shearing bushing 23 may be variable, for example, by adjusting the pivoting axis 39 of the pivoting stop 36 or by the choice of stop arms 37 of different lengths. The stop 36 determines the length of advance of the rod material 22 and consequently the length of the workpiece blank 40 which is cut off from the rod 22 and which is to be subjected to the shaping operation.

Figure 4:
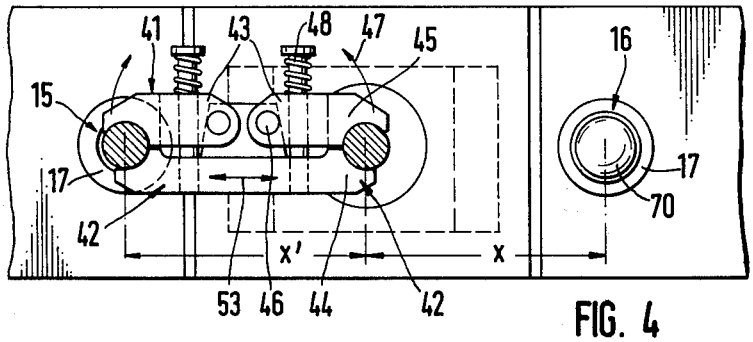
FIG. 4 is a station taken along line IV—IV in FIG. 3.

At the ejection side of the shearing bushing 23 there is also arranged a feed device indicated generally at 41, whereby the workpieces or blanks 40, after being cut from the rod material 22, are fed alternately to one of the two press molds 15, 16. In the practical form of the invention shown in FIGS. 1 to 4, the feed device 41 comprises a slide 43 which can be carried in guide rails provided upon the frame yoke 18. The slide 43 comprises two oppositely directed sets of grippers 43 having a lower jaw 44, which in the example of the illustrated embodiment embraces an arc of about 90° of a circular cross section workpiece. An upper jaw 45 can be swung out or pivoted in the direction of the arrow 47 (FIG. 4) about a transverse pin 46, a compression spring 48 providing an adjustable resistance against such pivoting movement.

Between two extensions 49 (FIG. 1) of the slide 42 there engages one end of a further double armed lever 50, which is also mounted upon the pivot shaft 31 in the frame 1 and whose other end 51 engages in a further tracking groove 52 in the cam disc 34. By these means the slide 42 performs a reciprocatory movement in the direction of the arrow 53 (FIG. 4) between the two press molds 15 and 16. The spacing distance x′ (FIG. 4) between the two sets of grippers 42 corresponds in this case to the spacing distance x between the ejection aperture 35 of the shearing bushing 23 and each respective press mold 15 and 16.

Figure 5:
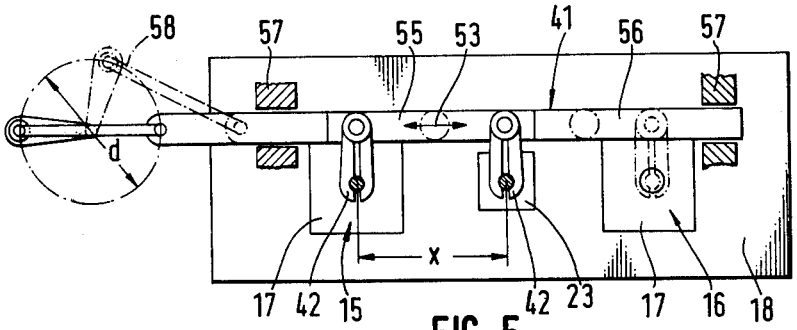
FIG. 5 is a modified practical form of the feed device in a view corresponding to that of FIG. 4.

FIG. 5 shows an alternative embodiment of a further practical form of the feed device 41, wherein a slide 55 which carries two sets of grippers 42 is provided with side extensions 56 which are mounted in ball bearing sleeves or the like 57. The drive for producing the reciprocating motion of the feed device 41 in the direction of arrow 53 may be provided by a crank arrangement 58, wherein the diameter d corresponds to the spacing distance x between each of the two press molds 15 and 16 and the ejection aperture 35 of the shearing bushing 23.

Figure 6:
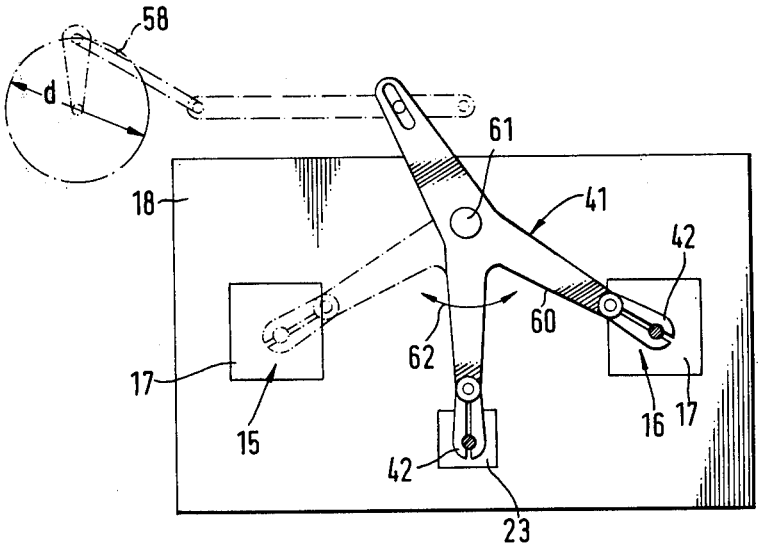
FIG. 6 is a further modified form of the feed device.

In FIG. 6 there is shown another alternative embodiment of a feed device 41 in the form of a double armed pivoting lever 60 having two sets of grippers 42 and pivotally mounted about an axis 61 parallel to the axis of the shearing bushing 23 to swing between the ejection aperture 35 of the shearing bushing 23 and a respective one of the two press molds 15 and 16, the direction of pivotal movement being shown by the arrow 62. In this case also the motion of the pivoting arm 60 can be derived from a crank drive 58. However, instead of using such a crank drive it is also possible to use a crank disc and cam shaft as the driving means, such means again being coupled to the drive shaft of the press.

Figure 7:
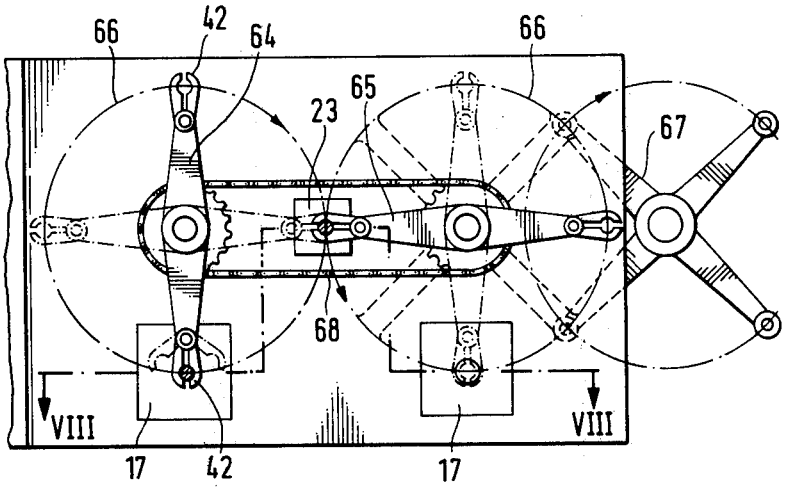
FIG. 7 is a third modified form of the feed device.
Figure 8:
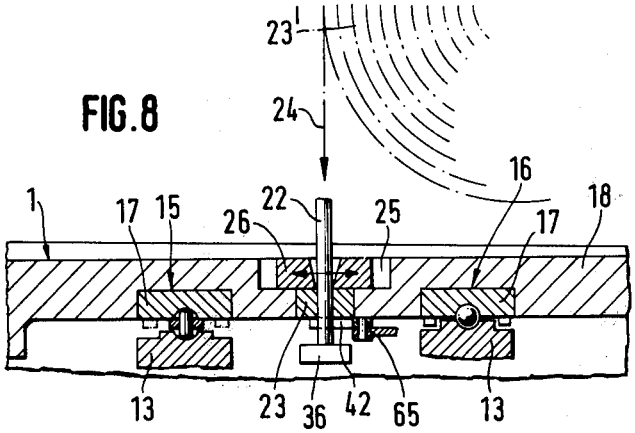
FIG. 8 is a sectional view taken along the line VIII—VIII in FIG. 7.

A further alternative type of feed device 41 is shown in FIGS. 7 and 8. This feed device comprises two pivoting arms 64 and 65 mounted on axes parallel to each other and parallel to the axis of the shearing bushing 23, these pivoting arms 64, 65 carrying sets of grippers 42 at each end thereof. The respective pivoting arms 64, 65 are staggered 90° with respect to each other, and the track described by the sets of grippers 42 touch each other at a point corresponding to the position of the ejection aperture of the shearing bushing 23. Moreover one of the press molds 15 and 16 respectively is situated on each of the circular tracks 66. The pivoting arm 65 in the embodiment of FIG. 7, is driven inermittently from a Maltese cross 67, whose type of construction is known per se. The two pivoting arms 64 and 65 are coupled through a chain drive 68 or gear wheels to achieve the necessary operating synchronism.

The arrangement operates as follows. From the supply roll 23′ the rod or strip form stock material 22 is advanced between the transporting rollers 19 and 20 and the roller 21 into the annular knife 26 and the shearing bushing 23. The length of feed is limited by the adjustabled stop 36. Upon the crank disc 34 being rotated by the crank shaft 4 of the eccentric press, the double armed lever 30 performs a reciprocating motion, which is transmitted to the annular knife 26. This motion corresponds to about ⅓ of the diameter *y* of the rod material 22, which is guided while being prevented from performing lateral motion, out of the aperture of the shearing bushing 23, which serves as a counteracting cutter. The small movement of the annular cutter 26 suffices to separate the material, because this fracture occurs over the remaining cross section of the thickness. Upon leaving the ejection aperture 35 of the shearing bushing 23, the blank 40 which is to be molded is gripped by the grippers 42 of the feed device 41 which are situated at this time in front of the ejection aperture 35. For this purpose it is preferably arranged that the pivoted jaw 45 of the grippers is slightly raised.

In the practical form of the invention according to FIGS. 1 to 4, in the course of revolution of the crank shaft 4 and the cam disc 34 the double armed lever 50 is operated, and as a result the feed device 41 is so displaced that the set of grippers 42 which have accepted a blank 40 in front of the ejection aperture 35 is conveyed to that one of the press molds 15 or 16 which, during the resulting opening movement of the die 13, has released or ejected the completely molded workpiece 70. In FIG. 3 this is the case with the press mold 16. The introduction of the blank 40 into the respective press mold 15 or 16 takes place when the dies 13 and 17 have practically reached their maximum opening position. In the immediately following closing movement of the die 13 the blank 40 is gripped and is compressed against the fixed die 17. At the same time the return motion of the feed device 41 is initiated, whereupon the still closed grippers 42 snap away from the blank 40 held fast in the meantime by the press mold. The set of grippers 42 thus vacated, now returns into the receiving position in front of the shearing bushing 23.

At the same instant as the set of grippers 42 introduces the blank 40 into the opened press mold 15 or 16, another set of grippers 42 of the same feed device 41 is situated in the receiving position in front of the ejection aperture of the shearing bushing 23 and receives a new blank, whose advancement is effected by the stock feeding device for such a distance that it strikes against the stop 36 situated opposite the ejection aperture 35. If the feed device 41 according to FIGS. 1 to 4 happens to be performing its transverse motion, any further advancement of the rod stock material 22 is blocked.

Figure 9:
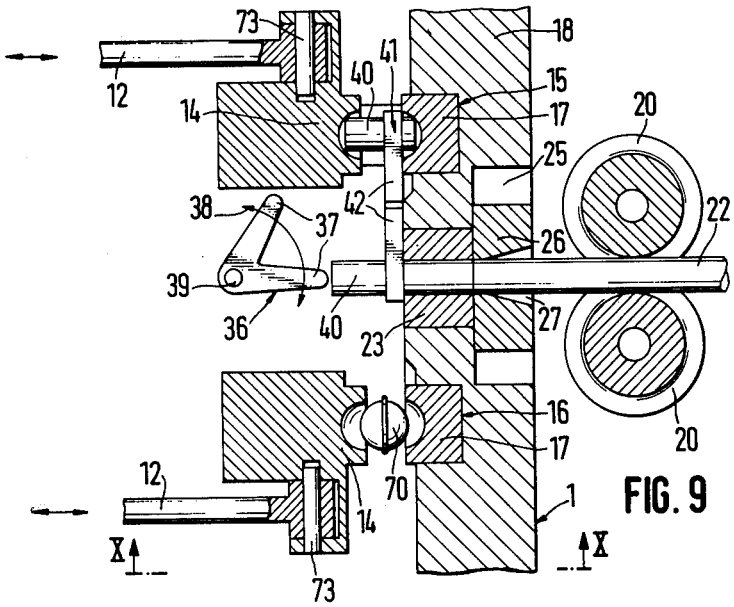
FIG. 9 is another practical form of the press is horizontal section.
Figure 10:
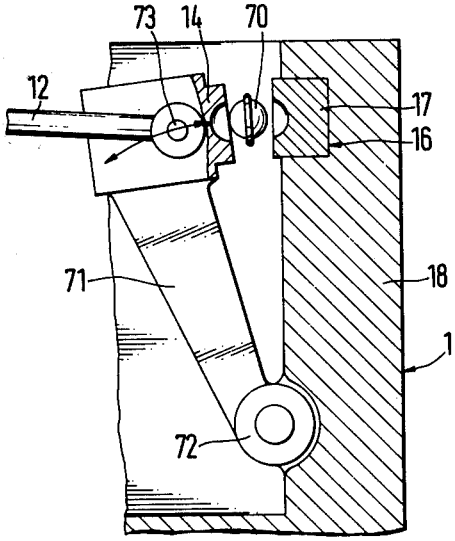
FIG. 10 is the same press in section taken along the line X—X of FIG. 9.

The practical form of the invention according to an alternative embodiment as shown in FIGS. 9 and 10 includes a rocking device 71 pivotally mounted about a shaft 72 in the yoke 18 of the frame 1 and carrying at its upper end the movable die 14 of the respective press mold 15 or 16. The crank connecting rod 12 extending from the eccentric shaft 4 is coupled through a pin 73 to the upper end of the rocking device 71. A particularly good application of the force is achieved in this practical form of the invention in consequence of the long lever arm of the rocking device 71.

The feed device 41 according to a further alternative embodiment shown in FIGS. 11 and 12 includes a rocker arm 74, which is pivotally mounted in the frame 1 by means of a shaft 95 and carries at its upper free end two adjacently arranged sets of grippers 42. Each of these sets of grippers consists of a fixed lower jaw 44 and a movable upper jaw 45. Each of these movable jaws 45 is mounted upon a plunger 75 which is fitted into guide 76 in the rocker arm 74. A spring 77 provides the necessary holding and returning force for the respective movable jaw 45 of the two sets of grippers 42. At the rear side 78 of the rocker arm 74 there are arranged in closely spaced relationship two guide rollers 79 whose peripheries bear against the respective sides 80 and 81 of a control face cam 82. This cam is field upon a shaft 83 which is in synchronous drive relationship with the drive of the press itself. The shaft 83 is mounted in bearings in the frame 1. The rotation of the shaft 83 produces a swash plate movement of the control cam disc 82 and, through the guide rollers 79, a corresponding reciprocating mothion of the rocker arm 74 in the sense of the double arrow 84 in FIG. 11. The amplitude of this oscillatory motion corresponds to the spacing distance of the two fixed dies 17. The spacing distance of the two sets of grippers 42 again corresponds to the distance between a respective die 17 and the ejection aperture 35 of the shearing bushing 23.

At each side of the control cam disc 82 there is mounted on the shaft 83 a control cam 85 whose periphery is in constant contact with a guide roller 86 on a rocker arm 87. The rocker arm 87 mounted upon a shaft 88 has another arm 89 which engages under the lower end 90 of the plunger 75 upon whose upper end is arranged the movable jaw 45 of the set of grippers 42. At each revolution of the shaft 83, the rocker arm 74 is reciprocated, for example, out of the initial position in FIG. 11. Also, at each of these revolutions, the respective cams 85 raise each of the two plungers 75 into the transfer position in front of the respective press mold so that the plunger 75 can release the workpiece 40 and can, in the next stroke, remove a new workpiece from the shearing bushing 23.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

I claim:

1. A press for forming articles such as sphere-like objects and the like from workpieces comprising a frame, a crankshaft rotatably mounted on said frame, said crankshaft having crank arms, movable dies actuated by each of said crank arms, two fixed mating dies mounted on said frame, a stationary shearing bushing means disposed between said two fixed dies, means for feeding an elongated rod to said shearing bushing means, said shearing bushing means having an entry side and an exit side, a movably mounted shearing knife means mounted on the entry side of said shearing bushing means for cutting blanks from said elongated rod, a movably mounted feeding means mounted on the exit side of said shearing bushing means and operable to simultaneously receive a cut blank at the exit side of said shearing bushing means while delivering another cut blank to one of said fixed dies.

2. A press according to claim 1 wherein said shearing knife means is an annular cutter arranged to guide said elongated rod and the stroke of said shearing knife means is smaller than the diameter of said elongated rod.

3. A press according to claim 1, further comprising a stop disposed at a distance from the exit side of said shearing bushing means for limiting the length of advance of said elongated rod.

4. A press according to claim 1 wherein said feeding means comprises at least two sets of grippers arranged to move about an axis substantially parallel to the axis of said shearing bushing means to describe at least an arcuate path between the exit side of said shearing bushing means and a respective fixed die.

5. A press according to claim 1 wherein said feeding means comprises a double armed pivoted lever of which each arm carries a set of grippers, and of which each arm reciprocates between the exit side of said shearing bushing means and a respective fixed die.

6. A press according to claim 1 wherein said feeding means comprises two synchronously driven pivoting arms each carrying a set of grippers at each end thereof, said pivoting arms being relatively angularly staggered and arranged to rotate about parallel pivoting axes to describe circular tracks which make contact with each other at a point which coincides with the position of the aperture at the exit side of said shearing bushing means while one of said fixed dies is situated upon a respective individual circular track.

7. A press according to claim 6 wherein said two pivoting arms are driven by a drive of the Maltese cross type.

8. A press according to claim 7 wherein said feeding means comprises two sets of grippers and is mounted to reciprocate in a linear path between the two fixed dies and the intervening shearing bushing means and the spacing distance of each fixed die from the shearing bushing means corresponds to the spacing distance between the two sets of grippers.

9. A press according to claim 1 wherein said feeding means comprises two sets of grippers having jaws, a single armed rocker driven in synchronism with the drive to the press and having for each set of grippers a lever-operated plunger for the purpose of opening the jaws of said grippers.

10. A press according to claim 9, wherein the oscillating motion of said rocker is derived from a control cam disc.

11. A press according to claim 1 wherein each of said movable dies is arranged upon the free end of a rocker which has its other end mounted in a bearing in said frome and said free end of the rocker is coupled to said crank arm.

12. A press according to claim 3 wherein the distance of said stop from the exit side of said shearing bushing means is adjustable.

13. A press according to claim 1 wherein said crank shaft comprises a cam disc means, and a pivotally mounted operating lever operably disposed between said cam disc means and said shearing knife means for operating the latter.

14. A press according to claim 13 comprising a second pivotally mounted operating lever operably disposed between said cam disc means and said feeding means for operating the latter.

* * * * *